US011435102B2

(12) United States Patent
Watanabe et al.

(10) Patent No.: US 11,435,102 B2
(45) Date of Patent: Sep. 6, 2022

(54) REFRIGERANT LEAKAGE DETERMINATION DEVICE, AIR-CONDITIONING APPARATUS, AND REFRIGERANT LEAKAGE DETERMINATION METHOD

(71) Applicant: Mitsubishi Electric Corporation, Tokyo (JP)

(72) Inventors: Kazuki Watanabe, Tokyo (JP); Masahiko Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 112 days.

(21) Appl. No.: 17/040,265

(22) PCT Filed: May 10, 2018

(86) PCT No.: PCT/JP2018/018145
§ 371 (c)(1),
(2) Date: Sep. 22, 2020

(87) PCT Pub. No.: WO2019/215877
PCT Pub. Date: Nov. 14, 2019

(65) Prior Publication Data
US 2021/0018200 A1 Jan. 21, 2021

(51) Int. Cl.
*F24F 11/36* (2018.01)
*F24F 11/64* (2018.01)
(Continued)

(52) U.S. Cl.
CPC ..... *F24F 11/36* (2018.01); *F24F 11/52* (2018.01); *F24F 11/61* (2018.01); *F24F 11/64* (2018.01)

(58) Field of Classification Search
CPC .. F24F 11/36; F24F 11/64; F24F 11/52; F24F 11/61
See application file for complete search history.

(56) References Cited

U.S. PATENT DOCUMENTS 5,682,755 A * 11/1997 Uchida ..... F25B 49/043 62/476
5,927,087 A * 7/1999 Ishikawa ..... F25B 9/006 62/502
(Continued)

FOREIGN PATENT DOCUMENTS

EP 3 147 595 A1 3/2017
JP 2000-171130 A 6/2000
(Continued)

OTHER PUBLICATIONS

Office Action dated Jun. 29, 2021, issued in corresponding JP Patent Application No. 2020-517705 (and English Machine Translation).
(Continued)

*Primary Examiner* — Nelson J Nieves
(74) *Attorney, Agent, or Firm* — Posz Law Group, PLC

(57) ABSTRACT

The refrigerant leakage determination device includes a refrigerant detection sensor that detects presence of gas and transmits a concentration of the gas as a sensor output, an alarm device that issues an alarm about leakage of refrigerant, and a controller configured to control the alarm device based on the sensor output from the refrigerant detection sensor. The controller includes a storage device that stores two thresholds for the sensor output and two set times each having a length set for each threshold, and a processing device that, when the sensor output exceeds one or both of the two thresholds and a length of a time period during which the sensor output exceeds the one or both of the two thresholds is longer than either one of the two set times associated with the two thresholds, determines leakage of refrigerant and actuates the alarm device.

6 Claims, 5 Drawing Sheets

(51) Int. Cl.
*F24F 11/52* (2018.01)
*F24F 11/61* (2018.01)

(56) References Cited

U.S. PATENT DOCUMENTS

| | | | | |
|---|---|---|---|---|
| 6,205,798 | B1 * | 3/2001 | Porter | G01M 3/3227 62/131 |
| 2002/0121100 | A1 | 9/2002 | Yabuki et al. | |
| 2012/0273184 | A1 * | 11/2012 | Yang | F28F 27/00 165/200 |
| 2016/0081224 | A1 * | 3/2016 | Terävä | F25B 23/00 165/80.4 |
| 2019/0032941 | A1 | 1/2019 | Kawai et al. | |
| 2019/0170600 | A1 * | 6/2019 | Tice | G01M 3/16 |
| 2019/0170603 | A1 * | 6/2019 | Gupte | F25B 49/005 |
| 2019/0186769 | A1 * | 6/2019 | Zimmermann | F25B 49/005 |
| 2019/0390877 | A1 * | 12/2019 | Sakae | F25B 1/00 |
| 2020/0232685 | A1 * | 7/2020 | Swab | F02D 41/22 |
| 2020/0300493 | A1 * | 9/2020 | Watanabe | F24F 11/36 |
| 2021/0108819 | A1 * | 4/2021 | Chen | F24F 11/36 |

FOREIGN PATENT DOCUMENTS

| | | | |
|---|---|---|---|
| JP | 2005-016822 | A | 1/2005 |
| JP | 2014-145541 | A | 8/2014 |
| JP | 2017-053517 | A | 3/2017 |
| JP | 2017-211371 | A | 11/2017 |
| WO | 2016/046961 | A1 | 3/2016 |
| WO | 2017/175300 | A1 | 10/2017 |

OTHER PUBLICATIONS

International Search Report of the International Searching Authority dated Jul. 24, 2018 for the corresponding international application No. PCT/JP2018/018145 (and English translation).
Extended European Search Report dated Mar. 30, 2020 for the corresponding European patent application No. 18897870.4.
Office Action dated Aug. 4, 2021, issued in corresponding CN Patent Application No. 201880093189.X (and English Machine Translation).
Office Action dated Sep. 21, 2021, issued in corresponding JP Patent Application No. 2020-517705 (and English Machine Translation).
Office Action dated Feb. 8, 2022 issued in corresponding CN patent application No. 201880093189.X (and English translation).

* cited by examiner

REFRIGERANT LEAKAGE DETERMINATION DEVICE, AIR-CONDITIONING APPARATUS, AND REFRIGERANT LEAKAGE DETERMINATION METHOD

TECHNICAL FIELD

The present invention relates to a refrigerant leakage determination device including a gas sensor that detects refrigerant leakage, an air-conditioning apparatus including the refrigerant leakage determination device, and a refrigerant leakage determination method using the refrigerant leakage determination device.

BACKGROUND ART

Certain types of refrigerant used in existing air-conditioning apparatuses are flammable. In a case where flammable refrigerant has leaked out from an indoor unit, etc., of an air-conditioning apparatus, when the concentration of the leaking refrigerant exceeds a fixed concentration, there is a risk that the refrigerant is ignited. In the surrounding area of the air-conditioning apparatus, the concentration of the refrigerant greatly varies between during operation and during halt of the air-conditioning apparatus. For this reason, an air-conditioning system has been proposed in which operation information is obtained by a control substrate of the air-conditioning apparatus, a refrigerant concentration level at which an alarm is to be issued is changed on the basis of the information (see Patent Literature 1, for example). The air-conditioning system of Patent Literature 1 is controlled such that a detectable refrigerant concentration level of the refrigerant is lowered when the air-sending device is being operated such that the refrigerant can be detected even when the concentration of the refrigerant is low.

CITATION LIST

Patent Literature

Patent Literature 1: Japanese Unexamined Patent Application Publication No. 2017-53517

SUMMARY OF INVENTION

Technical Problem

The air-conditioning system of Patent Literature 1 suctions indoor air through an air inlet during operation of an indoor unit, and thus, suctions various substances which are used in an indoor space, together with the indoor air. Consequently, a refrigerant sensor detects the substances as refrigerant so that the air-conditioning system may erroneously detect leakage of refrigerant. In particular, in the air-conditioning system of Patent Literature 1, the detectable refrigerant concentration level is lowered during operation of an air-sending device so that the refrigerant sensor is likely to detect as a refrigerant a substance which is not refrigerant. Accordingly, the air-conditioning system tends to erroneously detect leakage of refrigerant.

The present invention solves the aforementioned problems, and provides a refrigerant leakage determination device for preventing erroneous detection of refrigerant leakage in an air-conditioning apparatus, the air-conditioning apparatus, and a refrigerant leakage determination method.

Solution to Problem

A refrigerant leakage determination device according to one embodiment of the present invention includes a refrigerant detection sensor that detects presence of gas and transmits a concentration of the gas as a sensor output, an alarm device that issues an alarm about leakage of refrigerant, and a controller configured to control the alarm device based on the sensor output from the refrigerant detection sensor, wherein the controller includes a storage device that stores two thresholds for the sensor output, and two set times each having a length set for each threshold, and a processing device that determines leakage of refrigerant and actuates the alarm device.

Advantageous Effects of Invention

The refrigerant leakage determination device according to one embodiment of the present invention includes the controller configured to control the alarm device. The controller includes the storage device that stores the two thresholds for the sensor output from the refrigerant detection sensor and the two set times each having a length set for each threshold. Further, the controller includes the processing device that determines that refrigerant leaks and actuates the alarm device when the sensor output exceeds one or both of the two thresholds and the length of a time period during which the sensor output exceeds the one or both of the two thresholds is longer than either one of the two set times associated with the two thresholds. Since the refrigerant leakage determination device determines leakage of refrigerant on the basis of the two thresholds and the two set times, erroneous detection in which other gas such as gas temporally generated due to the use of a spray in an indoor space is detected as refrigerant leakage can be prevented. As a result, in the refrigerant leakage determination device, the detection accuracy of refrigerant leakage can be improved.

DESCRIPTION OF EMBODIMENTS

Figure 1:
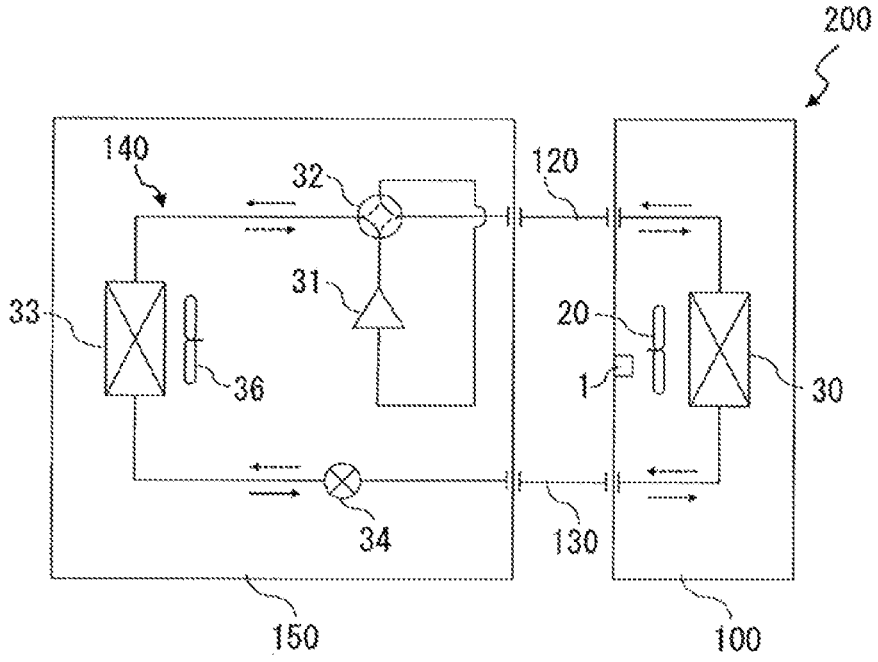
FIG. 1 is a schematic diagram illustrating the configuration of an air-conditioning apparatus including a refrigerant leakage determination device according to Embodiment 1 of the present invention.

A refrigerant leakage determination device 1, an air-conditioning apparatus 200, and a refrigerant leakage determination method according to embodiments of the present invention will be described hereinafter with reference to the drawings, etc. In the following drawings including FIG. 1, the relative dimension relationship among components and the shapes of the components may be different from actual ones. Furthermore, components denoted by the same reference numeral are identical to, or are equivalent to one another throughout the drawings. The same applies to the entire text in the description. Moreover, a term indicative of a direction (e.g., "up", "down", "right", "left", "front", "rear", etc.) is used as appropriate for easy understanding. However, such an expression is used for convenience of explanation, but does not place any limitation on the arrangement or direction of a device or a component.

Embodiment 1

[Air-Conditioning Apparatus 200]

FIG. 1 is a schematic diagram illustrating the configuration of the air-conditioning apparatus 200 including the refrigerant leakage determination device 1 according to Embodiment 1 of the present invention. The air-conditioning apparatus 200 causes heat to transfer between outdoor air and indoor air via refrigerant to heat or cool an indoor space, and thereby perform air conditioning. The air-conditioning apparatus 200 has an outdoor unit 150 and an indoor unit 100. In the air-conditioning apparatus 200, the outdoor unit 150 and the indoor unit 100 are connected by a refrigerant pipe 120 and a refrigerant pipe 130 so that a refrigerant circuit 140 in which refrigerant circulates is formed. In the refrigerant circuit 140 of the air-conditioning apparatus 200, a compressor 31, a flow switching device 32, an outdoor heat exchanger 33, an expansion valve 34, and an indoor heat exchanger 30 are connected via the refrigerant pipes.

(Outdoor Unit 150)

The outdoor unit 150 has the compressor 31, the flow switching device 32, the outdoor heat exchanger 33, and the expansion valve 34. The compressor 31 compresses refrigerant suctioned thereinto and discharges the refrigerant. Here, the compressor 31 may include an inverter device, and may be configured to change the operation frequency by means of the inverter device such that the capacity of the compressor 31 can be changed. The capacity of the compressor 31 refers to an amount of refrigerant to be fed per unit time. The flow switching device 32 is a four-way valve, for example, and is a device for switching the direction of a refrigerant flow path. The air-conditioning apparatus 200 switches the flow of refrigerant by using the flow switching device 32 on the basis of an instruction from a controller (not illustrated), so that heating operation or cooling operation can be performed.

The outdoor heat exchanger 33 exchanges heat between refrigerant and outdoor air. During the heating operation, the outdoor heat exchanger 33 functions as an evaporator to evaporate and gasify low-pressure refrigerant that has flowed in from the refrigerant pipe 130 by exchanging heat between the refrigerant and the outdoor air. During the cooling operation, the outdoor heat exchanger 33 functions as a condenser to condense and liquefy the refrigerant that has been compressed by the compressor 31 and has flowed in from the flow switching device 32 by exchanging heat between the refrigerant and the outdoor air. The outdoor heat exchanger 33 includes an outdoor air-sending device 36 to enhance the efficiency of heat exchange between the refrigerant and the outdoor air. In the outdoor air-sending device 36, an inverter device may be attached thereto to change the operation frequency of a fan motor, and thereby change the rotating speed of the fan. The expansion valve 34 is an expansion device (flow control unit), and functions as an expansion valve by regulating the flow rate of refrigerant flowing through the expansion valve 34, and changes the opening degree thereof to regulate the pressure of refrigerant. For example, when the expansion valve 34 is made up of an electronic expansion valve or other valves, the opening degree thereof is adjusted on the basis of an instruction from a controller (not illustrated) or other devices.

(Indoor Unit 100)

The indoor unit 100 includes the indoor heat exchanger 30 that exchanges heat between refrigerant and indoor air, and an air-sending device 20 that adjusts the flow of air on which heat exchange is performed by the indoor heat exchanger 30. In addition, the indoor unit 100 includes the refrigerant leakage determination device 1 that detects leakage of refrigerant being used in the refrigeration cycle and issues an alarm. The configuration and operation of the refrigerant leakage determination device 1 will be described in detail later. During the heating operation, the indoor heat exchanger 30 functions as a condenser to condense and liquefy refrigerant having flowed in from the refrigerant pipe 120 by heat exchange between the refrigerant and the indoor air, and cause the refrigerant to flow out toward the refrigerant pipe 130. During the cooling operation, the indoor heat exchanger 30 functions as an evaporator to evaporate and gasify the refrigerant of which the pressure has been reduced by the expansion valve 34, by causing the refrigerant to take heat from indoor air through heat exchange between the refrigerant and the indoor air, and causes the refrigerant to flow out toward the refrigerant pipe 120. The operating speed of the air-sending device 20 is determined by user setting. In the air-sending device 20, an inverter device may be attached thereto to change the operation frequency of a fan motor, and thereby change the rotating speed of the fan.

[Operation Example of Air-conditioning Apparatus 200]

Next, as an operation example of the air-conditioning apparatus 200, an operation during the cooling operation will be described. High-temperature and high-pressure gas refrigerant compressed and discharged by the compressor 31 flows into the outdoor heat exchanger 33 via the flow switching device 32. The gas refrigerant having flowed in the outdoor heat exchanger 33 is condensed by heat exchange with outdoor air sent from the outdoor air-sending device 36, and flows out, as low-temperature refrigerant, from the outdoor heat exchanger 33. The refrigerant having flowed out from the outdoor heat exchanger 33 is expanded and decompressed by the expansion valve 34, and becomes low-temperature and low-pressure two-phase gas-liquid refrigerant. The two-phase gas-liquid refrigerant flows into the indoor heat exchanger 30 of the indoor unit 100 is evaporated by heat exchange with the indoor air sent by the air-sending device 20, and flows out, as low-temperature and low-pressure gas refrigerant, from the indoor heat exchanger 30. Here, the indoor air cooled by heat absorption by the refrigerant is blown off, as air-conditioning air (blown-off air), from the indoor unit 100 to the indoor space (space to be air-conditioned). The gas refrigerant having flowed out from the indoor heat exchanger 30 is suctioned into the compressor 31 via the flow switching device 32, and is compressed again. During the cooling operation of the air-conditioning apparatus 200, the aforementioned operation is repeated.

Next, as an operation example of the air-conditioning apparatus 200, operation during a heating operation will be described. High-temperature and high-pressure gas refrigerant compressed and discharged by the compressor 31 flows into the indoor heat exchanger 30 of the indoor unit 100 via the flow switching device 32. The gas refrigerant having flowed in the indoor heat exchanger 30 is condensed by heat exchange with indoor air sent from the air-sending device 20, and flows, as low-temperature refrigerant, out from the indoor heat exchanger 30. Here, indoor air heated by receiving heat from the gas refrigerant is blown off, as air-conditioning air (blown-off air), out from the indoor unit 100 to the indoor space (space to be air-conditioned). The refrigerant having flowed out from the indoor heat exchanger 30 is converted to low-temperature and low-pressure two-phase gas-liquid refrigerant by being expanded and decompressed by the expansion valve 34. The two-phase gas-liquid refrigerant flows into the outdoor heat exchanger 33 of the outdoor unit 150 is evaporated by heat exchange with outdoor air sent from the outdoor air-sending device 36, is converted to low-temperature and low-pressure gas refrigerant, and flows out from the outdoor heat exchanger 33. The gas refrigerant having flowed out from the outdoor heat exchanger 33 is suctioned into the compressor 31 via the flow switching device 32, and is compressed again. The aforementioned operation is repeated during the heating operation of the air-conditioning apparatus 200.

[Indoor Unit 100]

Figure 2:
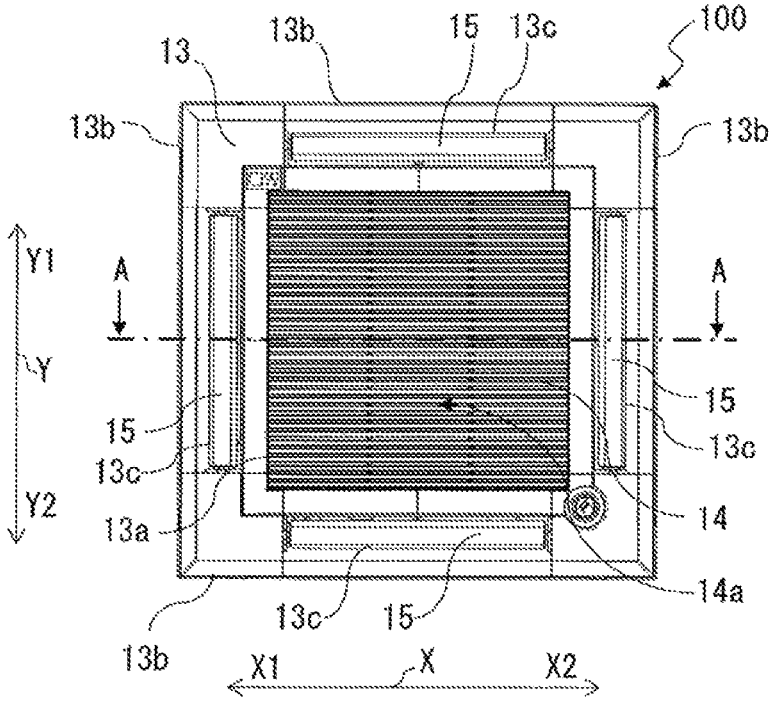
FIG. 2 is a bottom view of an indoor unit in FIG. 1.
Figure 3:
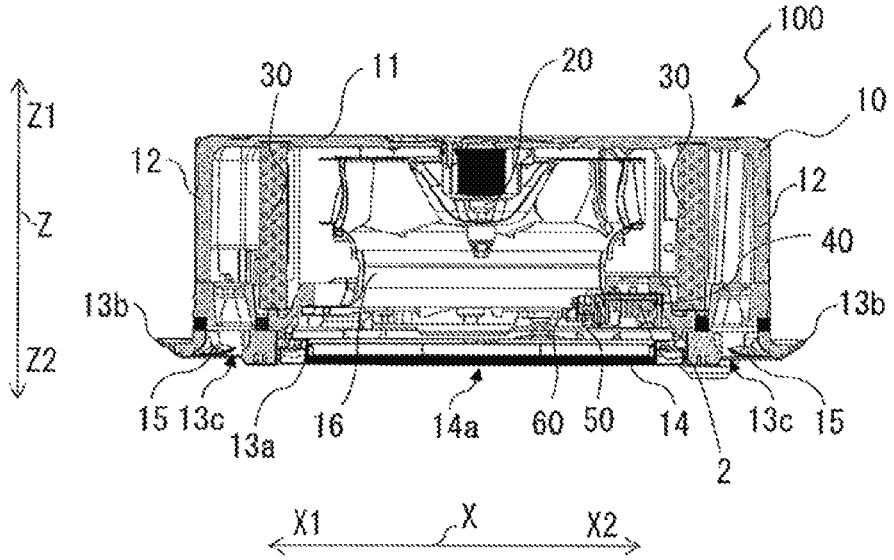
FIG. 3 is a cross sectional view of the indoor unit taken along line A-A in FIG. 2.

FIG. 2 is a bottom view of the indoor unit 100 in FIG. 1. FIG. 3 is a cross sectional view of the indoor unit 100 taken along line A-A in FIG. 2. In the following drawings including FIG. 1, an X axis indicates the lateral direction of the indoor unit 100, a Y axis indicates the front-and-back direction of the indoor unit 100, and a Z axis indicates the height direction of the indoor unit 100. More specifically, a description of the indoor unit 100 will be given wherein an X1 side and an X2 side are the left side and the right side of the X axis, respectively, a Y1 side and a Y2 side are the front side and the rear side of the Y axis, respectively, and a Z1 side and a Z2 side are the upper side and the lower side of the Z axis, respectively. Moreover, any positional relationship (e.g., the up-down relation, etc.) herein among the components basically indicates a relationship established when the indoor unit 100 is set in a usable state. The indoor unit 100 of Embodiment 1 is a ceiling concealed indoor unit that can be embedded in a ceiling of the indoor space, and is a four-way cassette type indoor unit with air outlets 13*c* formed in four directions. As illustrated in FIG. 1, the indoor unit 100 is connected to the outdoor unit 150 through the refrigerant pipe 120 and the refrigerant pipe 130 so that the refrigerant circuit 140 in which refrigerant circulates to carry out cooling and air-conditioning, etc. is formed. Refrigerant having a density higher than that of air is used in the indoor heat exchanger 30 of the indoor unit 100. However, refrigerant for use in the indoor heat exchanger 30 of the indoor unit 100 is not limited to one having a density higher than that of air. Refrigerant having a density equal to or lower than that of air may be used therefor.

The external configuration of the indoor unit 100 will be described by referring to FIGS. 2 and 3. As illustrated in FIG. 3, the indoor unit 100 has a casing 10 accommodating the air-sending device 20 and the indoor heat exchanger 30, etc. The casing 10 includes a top plate 11 constituting the top wall thereof, and side plates 12 constituting front, rear, left, and right side walls, and has an opening in the lower side (Z2 side) that faces the indoor space. Further, as illustrated in FIG. 2, a decorative panel 13 having a substantially rectangular shape in a plan view is attached to the opening portion in the casing 10.

The decorative panel 13 is a plate-like element, and has one surface facing an attachment portion of a ceiling, a wall, or other areas, and has the other surface facing the indoor space to be air-conditioned. As illustrated in FIGS. 2 and 3, an opening port 13*a* that is a through hole is formed near the center of the decorative panel 13, and a suction grille 14 is attached to the opening port 13*a*. In the suction grille 14, air inlets 14*a* through which gas flows from the indoor space to be air-conditioned into the casing 10 are formed. A filter (not illustrated) for removing dust from air having passed through the suction grille 14 is disposed closer to the casing 10 of the suction grille 14. In the decorative panel 13, air outlets 13*c* through which gas flows out are formed between an outer edge 13*b* of the decorative panel 13 and the inner edge forming the opening port 13*a*. The air outlets 13*c* are formed to extend along the four sides of the decorative panel 13. Respective vanes 15 that change the air flow are provided in the air outlets 13*c*. The casing 10 forms, in the casing 10, an air path between the air inlets 14*a* and the air outlets 13*c*.

Figure 4:
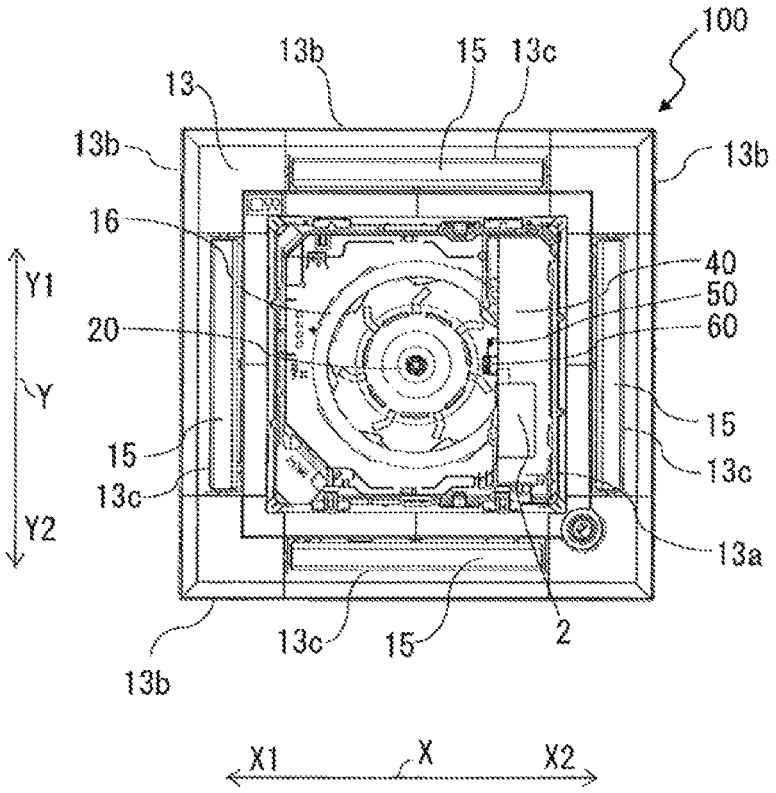
FIG. 4 is a bottom view of the indoor unit in FIG. 2 from which a suction grille has been removed.

FIG. 4 is a bottom view of the indoor unit 100 in FIG. 2 from which the suction grille 14 has been removed. Next, the inner configuration of the indoor unit 100 will be described by referring to FIGS. 3 and 4. The indoor unit 100 includes the air-sending device 20 that causes an inflow of indoor gas from the air inlets 14*a*, and causes the outflow of gas from the air outlets 13*c* to the indoor space. The air-sending device 20 is disposed in the casing 10, while facing the suction grille 14. Further, the air-sending device 20 is disposed in the casing 10 with the rotation axis of the air-sending device 20 directed to the vertical direction (Z-axis direction).

The indoor unit 100 further includes the indoor heat exchanger 30 disposed in the air path between the air-sending device 20 and the air outlets 13*c* in the casing 10. The indoor heat exchanger 30 exchanges heat between refrigerant flowing through the indoor heat exchanger 30 and air flowing through the air path. The indoor heat exchanger 30 generates air-conditioning air by exchanging heat between the refrigerant flowing through the indoor heat exchanger 30 and the indoor air. The indoor heat exchanger 30 is a fin tube type heat exchanger, for example, and is disposed on the downstream side, in the gas flow, from the air-sending device 20, and surrounds the air-sending device 20. In the casing 10, the air-sending device 20 and the indoor heat exchanger 30 are disposed on the air downstream side from the air inlets 14*a*, and are disposed on the air upstream side from the air outlets 13*c*. Also, in the indoor unit 100, the air-sending device 20 is disposed above the suction grille 14, and the indoor heat exchanger 30 is disposed in the radial direction from the air-sending device 20. Moreover, in the indoor unit 100, the suction grille 14 is disposed below the indoor heat exchanger 30.

In addition, the indoor unit 100 includes a bell mouse 16. As illustrated in FIGS. 3 and 4, the bell mouse 16 is provided, on an air inflow side of the indoor unit 100, upstream from the air-sending device 20. The bell mouse 16 regulates gas having flowed therein from the air inlet 14*a* of the suction grille 14, and sends the gas to the air-sending device 20.

Further, the indoor unit 100 includes, in the casing 10, an electric component box 40 between the bell mouse 16 and the suction grille 14. The electric component box 40 is provided therein a device such as a controller 2 that controls the entirety of the air-conditioning apparatus 200. A device in the electric component box 40 supplies electric power to the devices in the indoor unit 100, and exchanges signals (communicates) with the devices constituting the air-conditioning apparatus 200. The electric component box 40 is formed to have a substantially cuboid shape. The electric component box 40 is disposed in the opening port 13*a* formed in the decorative panel 13, in a plan view when viewed from the indoor space side to the ceiling. The electric component box 40 is disposed with the lengthwise direction thereof extending along an edge of the decorative panel 13 constituting one side of the opening port 13*a*. The electric component box 40 is fixed inside the casing 10 with a fixing element such as a screw.

Moreover, the indoor unit 100 includes a refrigerant detection sensor 50 that detects leakage of refrigerant. The refrigerant detection sensor 50 is disposed in a sensor holder 60. The refrigerant detection sensor 50 is driven by power supply from the indoor unit 100 or by power supply from an external power source at a site where the indoor unit 100 is set. In a case where the refrigerant detection sensor 50 is not configured to be driven by power supply from the indoor unit 100 or the external power source, a battery incorporated in the electric component box 40 or the sensor holder 60 may be used, for example. The sensor holder 60 fixes the refrigerant detection sensor 50 in the casing 10, and also protects the refrigerant detection sensor 50 from dust, etc. The sensor holder 60 is inserted in the electric component box 40, and is fixed to the electric component box 40. Therefore, the refrigerant detection sensor 50 is disposed below the indoor heat exchanger 30, and is disposed near the air inlets 14*a* formed in the suction grille 14.

[Refrigerant Leakage Determination Device 1]

Figure 5:
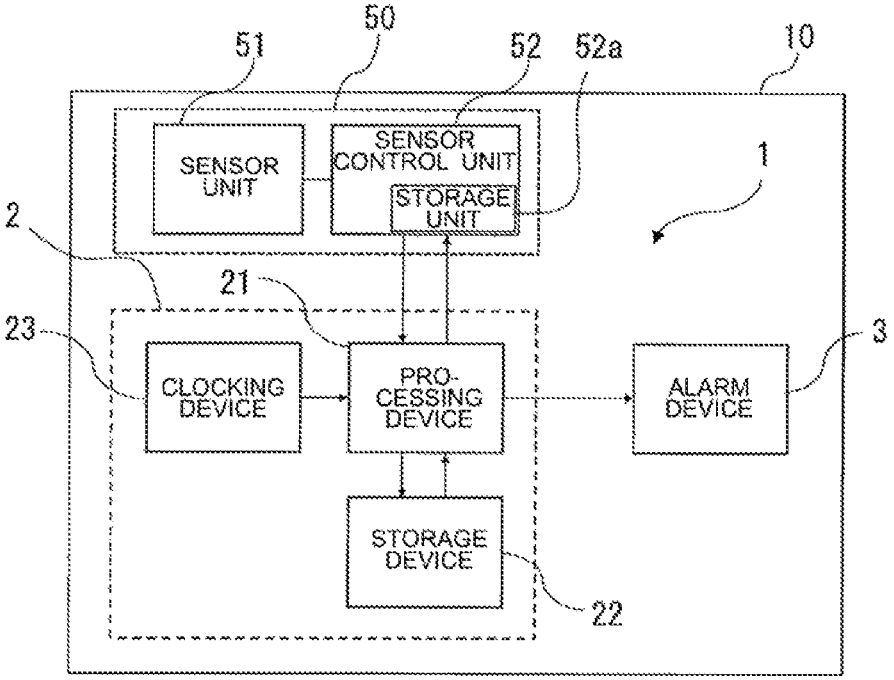
FIG. 5 is a block diagram of the refrigerant leakage determination device according to Embodiment 1 of the present invention.

FIG. 5 is a block diagram of the refrigerant leakage determination device 1 according to Embodiment 1 of the present invention. In the air-conditioning apparatus 200, the refrigerant leakage determination device 1 detects that refrigerant used in the refrigeration cycle has been leaked, and issues an alarm. The refrigerant leakage determination device 1 is disposed inside the casing 10 of the indoor unit 100 constituting the air-conditioning apparatus 200, and includes the controller 2 that controls the air-conditioning apparatus 200, the refrigerant detection sensor 50 that detects leakage of refrigerant, and an alarm device 3 that issues an alarm about leakage of refrigerant.

(Controller 2)

The controller 2 controls the alarm device 3 on the basis of comparison of the sensor output from the refrigerant detection sensor 50 with information in a storage device 22. The controller 2 is a microcomputer, for example. The controller 2 includes a processing device 21 that executes processes in accordance with a program, the storage device 22 that stores the program, and a clocking device 23 that performs clocking. When determining leakage of refrigerant, the controller 2 actuates the alarm device 3 by sending an alarm signal to actuate the alarm device 3. When determining leakage of refrigerant during halt of the air-sending device 20, the controller 2 may actuate the air-sending device 20 to stir stagnating refrigerant.

The processing device 21 of the controller 2 determines whether or not refrigerant has leaked on the basis of comparison of the sensor output transmitted from the refrigerant detection sensor 50 with the information in the storage device 22. When the sensor output from the refrigerant detection sensor 50 exceeds thresholds stored in the storage device 22 and the length of a time period during which the sensor output exceeds one or both of two thresholds is longer than either one of two set times each associated with the two thresholds stored in the storage device 22, the processing device 21 determines that refrigerant has leaked. When determining leakage of refrigerant, the processing device 21 actuates the alarm device 3. The processing device 21 is a control arithmetic processing device such as a central processing unit (CPU).

In the storage device 22 of the controller 2, the two thresholds, which are for the sensor output from the refrigerant detection sensor 50 and are preliminarily set by an operator, and the two set times each having a prescribed length set by the operator for each threshold are stored. Information about the two thresholds and the two set times is stored in the storage device 22 by the operator. The storage device 22 includes a volatile storage device (not illustrated) and/or a nonvolatile auxiliary storage device (not illustrated). Examples of the volatile storage device (not illustrated) include a random access memory (RAM) that can temporarily store data. Examples of the nonvolatile auxiliary storage device include a hard disk or a flash memory that can store data for a long time period.

The clocking device 23 of the controller 2 includes a timer, etc., and clocks a time for use in determination of a time period by the processing device 21.

(Refrigerant Detection Sensor 50)

The refrigerant detection sensor 50 is a gas sensor that detects presence of gas and transmits the concentration of the gas as a sensor output. The refrigerant detection sensor 50 is a semiconductor gas sensor, for example. In the semiconductor gas sensor, when reducing gas comes into contact with a detection unit, oxygen atoms in the detection unit desorb. Thus, the electric resistance of the detection unit is reduced. The semiconductor gas sensor detects the gas on the basis of reduction of the electric resistance. The refrigerant detection sensor 50 includes a sensor unit 51 for detecting gas, and a sensor control unit 52 that converts the detection result by the sensor unit 51 into a sensor output (ppm), and transmits the sensor output (ppm) to the controller 2. The refrigerant detection sensor 50 is connected to the controller 2 by a cable or radio. The sensor output (ppm), which is based on the electric resistance value of the refrigerant detection sensor 50, is received by the controller 2. The sensor control unit 52 includes a storage unit 52*a*, and thus, can save the sensor output (ppm). For example, the sensor control unit 52 is a microcomputer having a control arithmetic processing device such as a central processing unit (CPU). Also, the storage unit 52*a* includes a volatile storage device (not illustrated) and/or a nonvolatile auxiliary storage device (not illustrated). Examples of the volatile storage device (not illustrated) include a random access memory (RAM) that can temporarily store data. Examples of the nonvolatile auxiliary storage device include a hard disk or a flash memory that can store data for a long time period.

(Alarm Device 3)

The alarm device 3 is a device that issues an alarm about leakage of refrigerant and causes a person to know the leakage of refrigerant. The alarm device 3 is connected to the controller 2 by a cable or radio, and when the controller 2 detects leakage of refrigerant, the alarm device 3 receives an alarm signal transmitted from the controller 2 and issues an alarm. In a method of issuing an alarm by means of the alarm device 3, a warning sound of a buzzer, etc., is emitted, for example, whereby an alarm about leakage of refrigerant is given to people by use of the sound. Alternatively, in a method of issuing an alarm by means of the alarm device 3, a warning lamp, etc., is lit or is caused to flash, for example, whereby an alarm about leakage of refrigerant may be given to people by use of the light. Alternatively, in a method of issuing an alarm by means of the alarm device 3, an alarm about leakage of refrigerant may be given to people by use of both the sound and the light.

Figure 6:
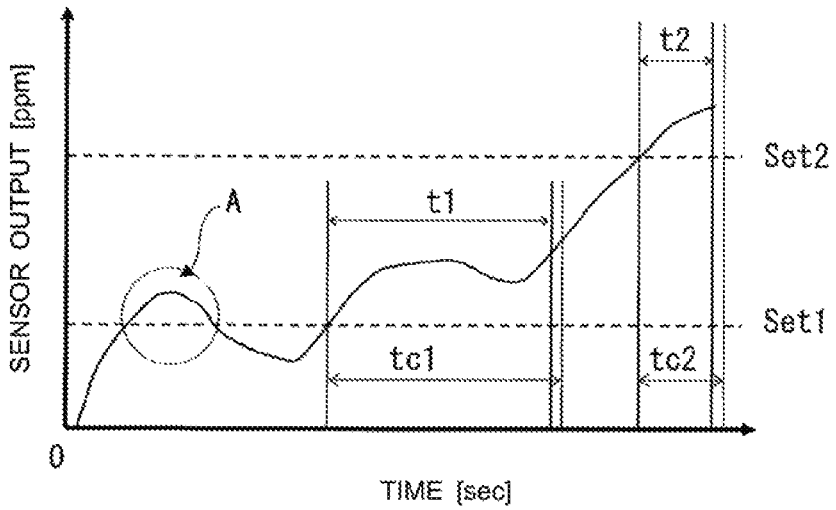
FIG. 6 is a diagram showing an alarm condition in the refrigerant leakage determination device according to Embodiment 1 of the present invention.

FIG. 6 is a diagram showing an alarm condition of the refrigerant leakage determination device 1 according to Embodiment 1 of the present invention. FIG. 6 shows an alarm condition of the refrigerant leakage determination device 1. The alarm condition refers to a condition under which leakage of refrigerant is determined by the controller 2. In addition, a sensor output shown in FIG. 6 indicates a refrigerant concentration [ppm] obtained by converting the output voltage from the refrigerant detection sensor 50.

A first set value Set1 and a second set value Set2 shown in FIG. 6 are two thresholds for the sensor output from the refrigerant detection sensor 50. The two thresholds are preliminarily set by an operator, and are stored in the storage device 22. As shown in FIG. 6, the second set value Set2 is greater than the first set value Set1. That is, the aforementioned two thresholds stored in the storage device 22 include the first set value Set1 and the second set value Set2 that is greater than the first set value Set1.

A first alarm postponement time t1 and a second alarm postponement time t2 shown in FIG. 6 are two set times having a prescribed length preliminary set by the operator for each threshold. The two set times are preliminarily stored in the storage device 22. As shown in FIG. 6, the first alarm postponement time t1 is longer than the second alarm postponement time t2. That is, the aforementioned two set times stored in the storage device 22 include the first alarm postponement time t1 and the second alarm postponement time t2 that is shorter than the first alarm postponement time t1.

When the sensor output from the refrigerant detection sensor 50 exceeds the first set value Set1 and a time period of the state where the sensor output exceeds the first set value Set1 is longer than the first alarm postponement time t1, the processing device 21 of the controller 2 determines that refrigerant leaks. That is, when the sensor output from the refrigerant detection sensor 50 exceeds the first set value Set1 and the length (elapsed time tc1) of a time period during which the sensor output continues to exceed the first set value Set1 after the sensor output exceeded the first set value Set1 is longer than the first alarm postponement time t1, the processing device 21 determines that refrigerant leaks. Alternatively, when the sensor output from the refrigerant detection sensor 50 exceeds the second set value Set2 and a time period of the state where the sensor output exceeds the second set value Set2 is longer than the second alarm postponement time t2, the processing device 21 of the controller 2 determines that refrigerant leaks. That is, when the sensor output from the refrigerant detection sensor 50 exceeds the second set value Set2 and the length (elapsed time tc2) of a time period during which the sensor output continues to exceed the second set value Set2 after the sensor output exceeded the second set value Set2 is longer than the second alarm postponement time t2, the processing device 21 of the controller 2 determines that refrigerant leaks. After determining leakage of refrigerant, the processing device 21 of the controller 2 understands that the alarm condition has been satisfied, and issues an alarm via the alarm device 3.

[Refrigerant Leakage Determination Method]

Figure 7:
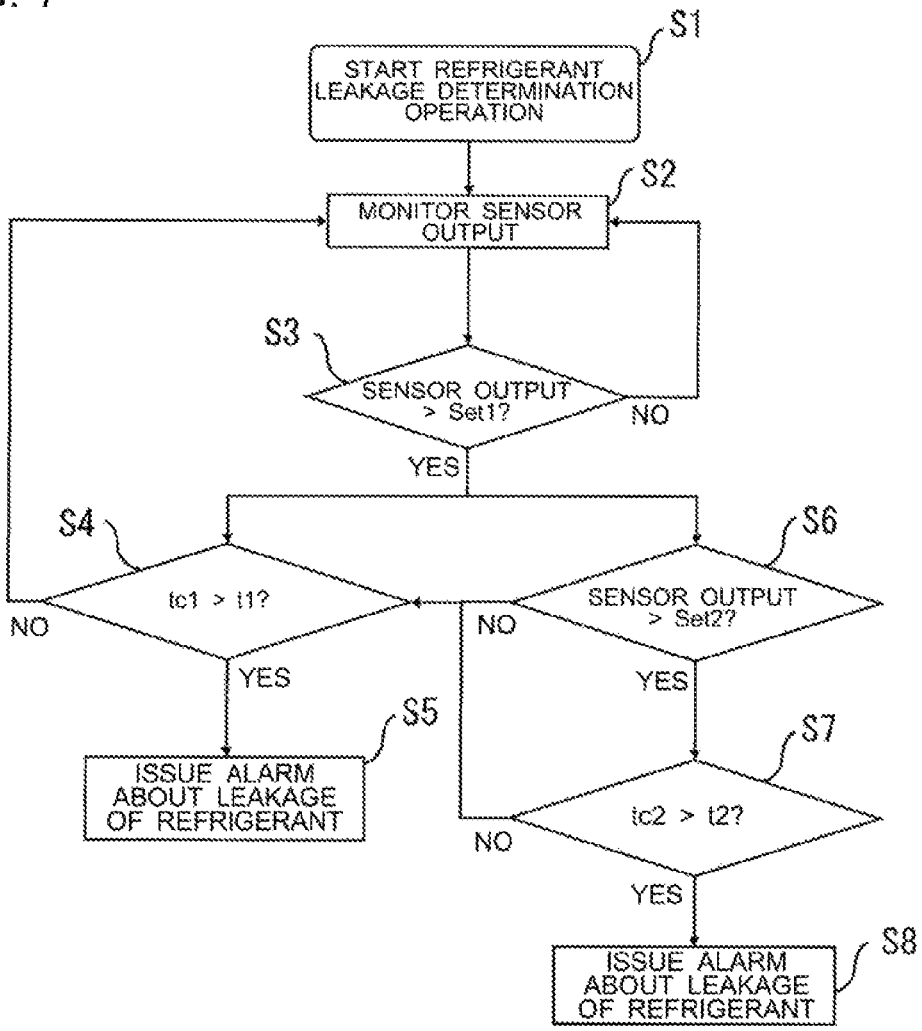
FIG. 7 is a flowchart of the refrigerant leakage determination device according to Embodiment 1 of the present invention.

FIG. 7 is a flowchart of the refrigerant leakage determination device 1 according to Embodiment 1 of the present invention. Next, a determination method in the refrigerant leakage determination device 1 will be described by referring to FIGS. 6 and 7. Power is supplied to the indoor unit 100, the refrigerant leakage determination device 1 is actuated, and thus, a refrigerant leakage determination operation is started (step S1). The controller 2 monitors the sensor output [ppm] obtained by converting the output voltage from the refrigerant detection sensor 50 (step S2). The processing device 21 of the controller 2 determines whether or not the sensor output [ppm] is greater than the first set value Set1 stored in the storage device 22 by referring to the data stored in the storage device 22 (step S3). When determining that the sensor output [ppm] is equal to or less than the first set value Set1 by referring to the data stored in the storage device 22, the processing device 21 of the controller 2 continues monitoring the sensor output [ppm] obtained by converting the output voltage from the refrigerant detection sensor 50 (step S2). When determining that the sensor output [ppm] is greater than the first set value Set1, the processing device 21 of the controller 2 refers to the data stored in the storage device 22 and a time obtained by the clocking device 23. Subsequently, the processing device 21 of the controller 2 determines whether or not the elapsed time tc1 during which the sensor output continues to exceed the first set value Set1 after the first set value Set1 was exceeded is longer than the first alarm postponement time t1 stored in the storage device 22 (step S4). When determining that the elapsed time tc1 is longer than the first alarm postponement time t1, the processing device 21 of the controller 2 sends an alarm signal to the alarm device 3 to issue an alarm about leakage of refrigerant (step S5). When determining that the elapsed time tc1 is equal to or shorter than the first alarm postponement time t1 (for example, range A in FIG. 6), the processing device 21 of the controller 2 continues monitoring the sensor output [ppm] obtained by converting the output voltage from the refrigerant detection sensor 50 (step S2).

When determining that the sensor output [ppm] is greater than the first set value Set1 at step S3, the processing device 21 of the controller 2 refers to the data stored in the storage device 22. Subsequently, in parallel with (step S4), the processing device 21 of the controller 2 determines whether or not the sensor output [ppm] is greater than the second set value Set2 stored in the storage device 22 (step S6). The second set value Set2 is greater than the first set value Set1. When determining that the sensor output [ppm] is equal to or less than the second set value Set2 by referring to the data stored in the storage device 22, the processing device 21 of the controller 2 determines the relationship between the elapsed time tc1 of the first set value Set1 and the first alarm postponement time t1. That is, the processing device 21 of the controller 2 determines whether or not the elapsed time tc1 during which the sensor output continues to exceed the first set value Set1 after the first set value Set1 was exceeded is longer than the first alarm postponement time t1 stored in the storage device 22 (step S4). When determining that the sensor output [ppm] is greater than the second set value Set2 at (step S6), the processing device 21 of the controller 2 refers to the data stored in the storage device 22 and a time obtained by the clocking device 23. Subsequently, the processing device 21 of the controller 2 determines whether or not the elapsed time tc2 during which the sensor output continues to exceed the second set value Set2 after the second set value Set2 was exceeded is longer than the second alarm postponement time t2 stored in the storage device 22 (step S7). The second alarm postponement time t2 is shorter than the first alarm postponement time t1. When determining that the elapsed time tc2 is longer than the second alarm postponement time t2, the processing device 21 of the controller 2 sends an alarm signal to the alarm device 3 to issue an alarm about leakage of refrigerant (step S8). When determining that the elapsed time tc2 is equal to or shorter than the second alarm postponement time t2, the processing device 21 of the controller 2 determines the relationship between the elapsed time tc1 of the first set value Set1 and the first alarm postponement time t1. That is, the processing device 21 of the controller 2 determines whether or not the elapsed time tc1 during which the sensor output continues to exceed the first set value Set1 after the first set value Set1 was exceeded is longer than the first alarm postponement time t1 stored in the storage device 22 (step S4).

The refrigerant leakage determination device 1 includes the controller 2 that controls the alarm device 3, as described above. The controller 2 includes the storage device 22 that stores the two thresholds for the sensor output from the refrigerant detection sensor 50 and the two set times each having a length set for each threshold. The controller 2 further includes the processing device 21 that, when the sensor output from the refrigerant detection sensor 50 exceeds one or both of the two thresholds and the length of a time period during which the sensor output exceeds the one or both of the two thresholds is longer than either one of the two set time periods each associated with the two thresholds, determines that refrigerant leaks and actuates the alarm device. Since the refrigerant leakage determination device 1 determines leakage of refrigerant on the basis of the two thresholds and the two set times, erroneous detection in which other gases such as a gas temporarily generated due to the use of a spray in an indoor space, for example, is detected as leakage of refrigerant can be prevented. As a result, the refrigerant leakage determination device 1 can have an improved detection accuracy of refrigerant leakage.

In addition, the refrigerant leakage determination device 1 has two alarm points (conditions for issuing an alarm). At an alarm point 01, when the sensor output equal to or greater than the first set value Set1 continues for the first alarm postponement time t1 or longer, an alarm is issued. At an alarm point C2, when the sensor output equal to or greater than the second set value Set2 continues for the second alarm postponement time t2 or longer, an alarm is issued. Here, the alarm condition of the refrigerant leakage determination device 1 is that the first set value Set1<the second set value Set2, and the first alarm postponement time t1>the second alarm postponement time t2. The alarm point C1 is provided on an assumption that leakage of refrigerant is detected during operation of the indoor unit 100, and a purpose thereof is to detect refrigeration and to prevent erroneous detection. Specifically, when the first alarm postponement time t1 is set to 30 seconds, temporary erroneous detection due to a deodorant spray or an insecticide, for example, used by a user in a living environment can be prevented. In addition, the refrigerant leakage determination device 1 can address slight leakage of refrigerant (slow leakage) caused by corrosion due to the presence of an ant nest, for example, in an inner pipe of the indoor unit 100. The alarm point C2 is provided on an assumption that a leakage site in the indoor unit 100 is caused by a crack in a thick pipe, and a purpose thereof is to quickly detect refrigerant getting out vigorously when a crack is caused in a thick pipe. The refrigerant leakage determination device 1 has the alarm point C1 and the alarm point C2, such that erroneous detection of other gas, etc., can be prevented and reliable detection of leakage of refrigerant associated with a refrigerant leakage state can be realized. The alarm point C1 and the alarm point C2 may be normally enabled, irrespective of the state of the indoor unit 100. Alternatively, the alarm point C1 and the alarm point C2 may be enabled during operation of the indoor unit 100 and the alarm point C2 alone may be enabled during a halted time of the indoor unit 100.

Figure 8:
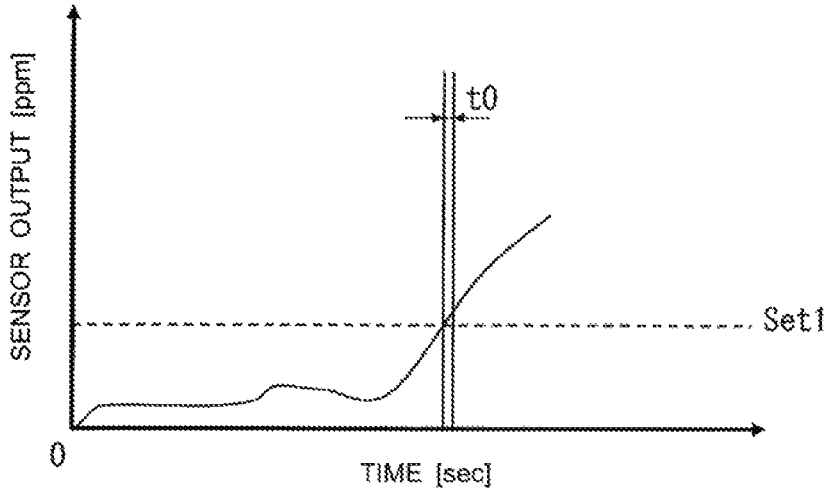
FIG. 8 is a diagram showing an alarm condition in the refrigerant leakage determination device of a comparative example.

FIG. 8 is a diagram showing an alarm condition of a refrigerant leakage determination device of a comparative example. As the refrigerant leakage determination device of the comparative example, a refrigerant leakage determination device that, without being provided with two alarm points, issues an alarm at a time point (t0) when the sensor output exceeds the first set value Set1, as shown in FIG. 8, may be used. However, in the refrigerant leakage determination device of the comparative example, since an alarm is issued at the time point (t0) when the sensor output exceeds the first set value Set1, various miscellaneous gases in use such as a gas generated due to the use of a spray may be detected. Consequently, the refrigerant leakage determination device of the comparative example may erroneously detect leakage of refrigerant. In contrast, the refrigerant leakage determination device 1 can reliably detect leakage of refrigerant by using the alarm point C1 and the alarm point C2, and also can prevent erroneous detection of refrigerant due to the use of a spray, etc., which has not been addressed by the conventional technique.

In the air-conditioning apparatus 200, the indoor unit 100 includes the refrigerant leakage determination device 1. Therefore, the air-conditioning apparatus 200 having effects of the refrigerant leakage determination device 1 can be obtained. Since the air-conditioning apparatus 200 includes the refrigerant leakage determination device 1 according to Embodiment 1, reliable detection of leakage of refrigerant in accordance with a refrigerant leakage state can be realized, and erroneous detection of refrigerant due to use of a spray, etc., which has not been addressed by the existing technique, can also be prevented.

The refrigerant leakage determination method includes a step of monitoring the sensor output from the refrigerant detection sensor 50 by means of the controller 2, and a step of determining whether or not the sensor output is greater than the first set value Set1 stored in the storage device 22 by referring to the data stored in the storage device 22. The refrigerant determination method further includes a step of, when the controller 2 determines that the sensor output is greater than the first set value Set1, referring to the data stored in the storage device 22 and the time of the clocking device 23, and determining, by means of the controller 2, whether or not the elapsed time tc1 during which the sensor output exceeds the first set value Set1 is longer than the first alarm postponement time t1 stored in the storage device 22. The refrigerant determination method further includes a step of, when the controller 2 determines that the sensor output is greater than the first set value Set1, referring to the data stored in the storage device 22, and determining, by means of the controller 2, whether or not the sensor output is greater than the second set value Set2 that is greater than the first set value Set1 and that is stored in the storage device 22. Moreover, the refrigerant leakage determination method includes a step of, when the controller 2 determines that the sensor output is greater than the second set value Set2, referring to the data stored in the storage device 22 and the time obtained by the clocking device 23, and determining, by means of the controller 2, whether or not the elapsed time tc2 during which the sensor output exceeds the second set value Set2 is longer than the second alarm postponement time t2 that is shorter than the first alarm postponement time t1 and that is stored in the storage device 22. Further, the refrigerant leakage determination method includes a step of, when the controller 2 determines that the elapsed time tc1 during which the sensor exceeds the first set value Set1 is longer than the first alarm postponement time t1, sending an alarm signal from the controller 2 to the alarm device 3 to issue an alarm about leakage of refrigerant. Alternatively, the refrigerant leakage determination method includes a step of, when the controller 2 determines that the elapsed time tc2 during which the sensor output exceeds the second set value Set2 is longer than the second alarm postponement time t2, sending an alarm signal from the controller 2 to the alarm device 3 to issue an alarm about leakage of refrigerant. The refrigerant leakage determination method includes a step using a combination of the two setting thresholds and the two alarm postponement times. Accordingly, reliable detection of leakage of refrigerant in accordance with a refrigerant leakage amount can be realized, and erroneous detection of refrigerant due to the use of a spray, etc., which has not been addressed by the existing technique, can also be prevented.

Embodiment 2

[Configuration of Refrigerant Leakage Determination Device 1]

Figure 9:
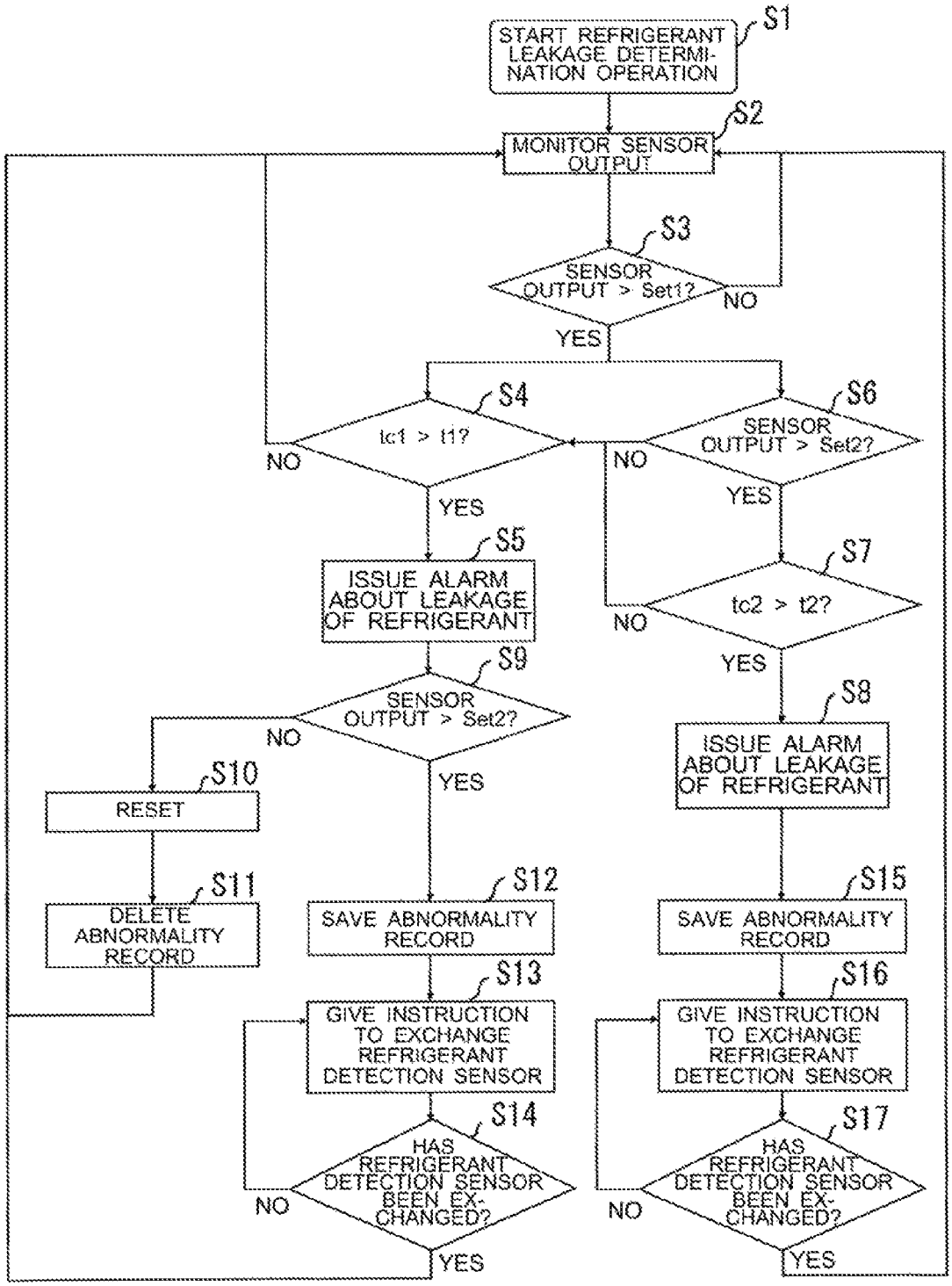
FIG. 9 is a flowchart of a refrigerant leakage determination device according to Embodiment 2 of the present invention.

FIG. 9 is a flowchart of the refrigerant leakage determination device 1 according to Embodiment 2 of the present invention. The configuration of the refrigerant leakage determination device 1 according to Embodiment 2 is identical to the configuration of the refrigerant leakage determination device 1 according to Embodiment 1. The refrigerant leakage determination device 1 according to Embodiment 2 is different in the post-refrigerant leakage determination operation from the refrigerant leakage determination device 1 according to Embodiment 1. Configurations, which are not specifically noted otherwise, of the refrigerant leakage determination device 1 according to Embodiment 2 are identical to those of the refrigerant leakage determination device 1 according to Embodiment 1 of the present invention, and functions or components identical to each other are denoted by the same reference signs.

The refrigerant detection sensor 50 uses a semiconductor as a gas sensing element. Therefore, in the refrigerant detection sensor 50, when the concentration of exposed refrigerant is high, the sensitivity of the sensor unit 51 may rapidly deteriorate. When the refrigerant leakage determination device 1 issues an alarm under the condition of the alarm point C1, the refrigerant concentration is low so that the deterioration level of the refrigerant detection sensor 50 is low. Thus, even after an alarm is issued, the refrigerant detection sensor 50 remains usable. On the other hand, when the refrigerant leakage determination device 1 issues an alarm under the condition of the alarm point C2, the sensor unit 51 is exposed to high-concentration refrigerant so that deterioration of the sensitivity of the sensor unit 51 may have progressed. Therefore, since a property detected by the refrigerant detection sensor 50 may be unintendedly shifted, continuous usage of the identical refrigerant detection sensor 50 after an alarm is issued is not desirable. An object of Embodiment 2 is to distinguish whether an alarm is issued by the refrigerant detection sensor 50 that is used in the refrigerant leakage determination device 1 on the basis of a reversible reaction of the sensor unit 51, or on the basis of an irreversible reaction of the sensor unit 51 due to exposure to high-concentration refrigerant.

[Refrigerant Leakage Determination Method]

A refrigerant leakage determination method for the refrigerant leakage determination device 1 according to Embodiment 2 is identical to the refrigerant leakage determination method composed of steps S1 to S8 for the refrigerant leakage determination device 1 according to Embodiment 2, and thus, an explanation thereof is omitted.

[Operation of Refrigerant Leakage Determination Device 1] (Case of Alarm Point C1)

When determining that the elapsed time tc1 is longer than the first alarm postponement time t1, the processing device 21 of the controller 2 sends an alarm signal to the alarm device 3 to issue an alarm about leakage of refrigerant (step S5). In this case, while issuing an alarm about leakage of refrigerant by means of the alarm device 3, the controller 2 continues monitoring the sensor output [ppm] obtained by converting the output voltage from the refrigerant detection sensor 50. Then, the processing device 21 of the controller 2 determines whether or not the sensor output [ppm] is greater than the second set value Set2, by referring to the data stored in the storage device 22 (step S9). When the sensor output [ppm] is equal to or less than the second set value Set2, an operator can reset the refrigerant leakage determination device 1 after handling the leakage of refrigerant (step S10). In a method for resetting the refrigerant leakage determination device 1, the resetting is performed by turning on a breaker of the air-conditioning apparatus 200 after once turning off the breaker, for example. When the operator resets the refrigerant leakage determination device 1, an abnormality record is deleted (step S11). The abnormality record refers to information indicating that refrigerant has leaked. After the abnormality record indicative of leakage of refrigerant is deleted, the controller 2 continues monitoring the sensor output [ppm] obtained by converting the output voltage from the refrigerant detection sensor 50 (step S2).

When the processing device 21 of the controller 2 determines that the sensor output [ppm] is greater than the second set value Set2 at (step S9), an abnormality record is stored in the storage unit 52*a* of the refrigerant detection sensor 50 (step S12). After the abnormality record is stored in the storage unit 52*a*, the abnormality record is not deleted even when the operator resets the refrigerant leakage determination device 1. In addition, even when the air-conditioning apparatus 200 and the indoor unit 100 are turned off, the abnormality record remains stored. After the abnormality record is stored in the storage unit 52*a*, the sensor control unit 52 of the refrigerant detection sensor 50 constantly transmits the sensor output [ppm] greater than the second set value Set2 to the controller 2. Subsequently, the controller 2 acknowledges that refrigerant has leaked, and issues an alarm by means of the alarm device 3 to give an instruction to exchange the refrigerant detection sensor 50 (step S13). That is, when the alarm device 3 is actuated after the operator handles leakage of refrigerant, the refrigerant detection sensor 50 needs to be exchanged. For the instruction to exchange the refrigerant detection sensor 50, the air-conditioning apparatus 200 may be controlled such that the air-conditioning apparatus 200 is not actuated by the controller 2, in association with the actuation of the alarm device 3 by the controller 2 or instead of the actuation of the alarm device 3 by the controller 2, for example. Alternatively, for the instruction to exchange the refrigerant detection sensor 50, an alarm may be issued from another device such as an LED, a liquid crystal display, or a loudspeaker, which is separated from the alarm device 3. In accordance with the instruction to exchange the refrigerant detection sensor 50, the operator exchanges the refrigerant detection sensor 50. The controller 2 determines whether or not the refrigerant detection sensor 50 has been exchanged (step S14). When the refrigerant detection sensor 50 has not been exchanged, the sensor control unit 52 of the refrigerant detection sensor 50 constantly transmits the sensor output [ppm] greater than the second set value Set2 to the controller 2 on the basis of the abnormality record stored in the storage unit 52*a*. Consequently, the controller 2 acknowledges that refrigerant has leaked, and issues an alarm by means of the alarm device 3 to give an instruction to exchange the refrigerant detection sensor 50 (step S13). When the refrigerant detection sensor 50 has been exchanged, no abnormality record is stored in the storage unit 52*a* of the new refrigerant detection sensor 50. Consequently, the controller 2 receives, from the sensor control unit 52, the sensor output obtained by converting the actual output voltage detected by the refrigerant detection sensor 50. Then, the controller 2 monitors the sensor output [ppm] obtained by converting the output voltage from the refrigerant detection sensor 50 (step S2).

(Case of Alarm Point C2)

When determining that the elapsed time tc2 is longer than the second alarm postponement time t2, the processing device 21 of the controller 2 sends an alarm signal to the alarm device 3 to issue an alarm about leakage of refrigerant (step S8). An abnormality record is stored in the storage unit 52*a* of the refrigerant detection sensor 50 (step S15) because the sensor output [ppm] is greater than the second set value Set2. After the abnormality record is stored in the storage unit 52*a*, the abnormality record is not deleted even when an operator resets the refrigerant leakage determination device 1. In addition, even after the air-conditioning apparatus 200 and the indoor unit 100 are turned off, the abnormality record remains stored. When the abnormality record is stored in the storage unit 52*a*, the sensor control unit 52 of the refrigerant detection sensor 50 constantly transmits the sensor output [ppm] greater than the second set value Set2 to the controller 2. Then, the controller 2 understands that refrigerant has leaked, and issues an alarm by means of the alarm device 3 to give an instruction to exchange the refrigerant detection sensor 50 (step S16). That is, when the alarm device 3 is actuated after the operator handles leakage of refrigerant, the refrigerant detection sensor 50 needs to be exchanged. For the instruction to exchange the refrigerant detection sensor 50, the air-conditioning apparatus 200 may be controlled such that the air-conditioning apparatus 200 is not actuated by the controller 2, in association with the actuation of the alarm device 3 by the controller 2 or instead of the actuation of the alarm device 3 by the controller 2, for example. Alternatively, for the instruction to exchange the refrigerant detection sensor 50, an alarm may be given from another device such as an LED, a liquid crystal display, or a loudspeaker, which is separated from the alarm device 3. In accordance with the instruction to exchange the refrigerant detection sensor 50, the operator exchanges the refrigerant detection sensor 50. The controller 2 determines whether or not the refrigerant detection sensor 50 has been exchanged (step S17). When the refrigerant detection sensor 50 has not been exchanged, the sensor control unit 52 of the refrigerant detection sensor 50 constantly transmits the sensor output [ppm] greater than the second set value Set2 to the controller 2 on the basis of the abnormality record stored in the storage unit 52*a*. Accordingly, the controller 2 acknowledges that refrigerant has leaked, and issues an alarm by means of the alarm device 3 to give an instruction to exchange the refrigerant detection sensor 50 (step S16). When the refrigerant detection sensor 50 has been exchanged, no abnormality record is stored in the storage unit 52*a* of the new refrigerant detection sensor 50. Accordingly, the controller 2 receives, from the sensor control unit 52, the sensor output obtained by converting the actual output voltage detected by the refrigerant detection sensor 50. Then, the controller 2 monitors the sensor output [ppm] obtained by converting the output voltage from the refrigerant detection sensor 50 (step S2).

As described above, the refrigerant detection sensor 50 includes the sensor unit 51 that detects gas, and the sensor control unit 52 that converts the detection result by the sensor unit 51 into the sensor output. In the refrigerant leakage determination device 1, when the processing device 21 determines that refrigerant leaks and the second set value Set2 is determined to be exceeded by the sensor output, an abnormality record is stored in the sensor control unit 52. After the abnormality record is stored, the sensor control unit 52 constantly transmits the sensor output that is exceeding the second set value Set2 to the controller 2. Therefore, the controller 2 acknowledges that refrigerant has leaked, and controls the alarm device 3 to issue an alarm. When the alarm from the alarm device 3 continues even after the operator turns off the air-conditioning apparatus 200 and turns on the air-conditioning apparatus 200 again, the operator understands that the alarm about leakage of refrigerant has been issued on the basis of the alarm point C2. Thus, the operator can understand that the refrigerant detection sensor 50, which has been exposed to high-concentration refrigerant, needs to be exchanged. That is, the controller 2 monitors the output from the refrigerant detection sensor 50 after the alarm is issued from the refrigerant leakage determination device 1 so that the operator can determine whether or not the refrigerant detection sensor 50 has been deteriorated, and can determine whether or not the refrigerant detection sensor 50 can be continuously used. Consequently, the refrigerant detection sensor 50 does not need to be exchanged whenever the refrigerant leakage determination device 1 issues an alarm. Reduction of the number of maintenance services and reduction of the material cost can be expected.

In the air-conditioning apparatus 200, the indoor unit 100 includes the refrigerant leakage determination device 1. Therefore, the air-conditioning apparatus 200 having effects of the refrigerant leakage determination device 1 can be obtained. That is, the controller 2 monitors the output from the refrigerant detection sensor 50 after an alarm is issued from the refrigerant leakage determination device 1 so that the operator can determine whether or not the refrigerant detection sensor 50 has been deteriorated, and can determine whether or not the refrigerant detection sensor 50 can be continuously used. Consequently, the refrigerant detection sensor 50 does not need to be exchanged whenever the refrigerant leakage determination device 1 used in the air-conditioning apparatus 200 issues an alarm. Reduction of the number of services and reduction of the material cost can be expected.

Further, the refrigerant leakage determination method includes a step of, when the controller 2 determines that the elapsed time tc1 during which the sensor output exceeds the first set value Set1 is longer than the first alarm postponement time t1, sending an alarm signal from the controller 2 to the alarm device 3 to issue an alarm about leakage of refrigerant. Alternatively, the refrigerant leakage determination method includes a step of, when the controller 2 determines that the elapsed time tc2 during which the sensor output exceeds the second set value Set2 is longer than the second alarm postponement time t2, sending an alarm signal from the controller 2 to the alarm device 3 to issue an alarm about leakage of refrigerant. The refrigerant leakage determination method further includes a step of, when the sensor output from the refrigerant detection sensor 50 is greater than the second set value Set2, storing an abnormality record in the storage unit 52*a* of the refrigerant detection sensor 50. The refrigerant leakage determination method further includes a step of, after the abnormality record is stored in the storage unit 52*a*, the sensor control unit 52 of the refrigerant detection sensor 50 constantly transmits the sensor output greater than the second set value Set2 to the controller 2. Therefore, the controller 2 acknowledges that refrigerant has leaked, and controls the alarm device 3 to issue an alarm. When an alarm from the alarm device 3 continues even after the operator turns off the air-conditioning apparatus 200 and turns on the air-conditioning apparatus 200 again, the operator understands that the alarm about leakage of refrigerant has been issued on the basis of the alarm point C2, so that the operator can understand that the refrigerant detection sensor 50, which has been exposed to high-concentration refrigerant, needs to be exchanged. That is, the controller 2 monitors the output from the refrigerant detection sensor 50 after the alarm is issued from the refrigerant leakage determination device 1 so that the operator can determine whether or not the refrigerant detection sensor 50 has been deteriorated, and can determine whether or not the refrigerant detection sensor 50 can be continuously used. Consequently, the refrigerant detection sensor 50 does not need to be exchanged whenever the refrigerant leakage determination device 1 issues an alarm. Reduction of the number of maintenance services and reduction of the material cost can be expected. In addition, by the refrigerant leakage determination method, leakage of refrigerant can be reliably detected, and erroneous detection of refrigerant due to use of a spray, etc., which has not been addressed by the existing technique, can also be prevented.

Embodiments of the present invention are not limited to aforementioned Embodiments 1 and 2, and various modifications can be made. In aforementioned Embodiment 1, the indoor unit 100 that is a four-way cassette type having the air outlets 13*c* formed in four directions has been described. However, the air outlets 13*c* may be formed in one or more directions including one direction and two directions, for example. Also, the indoor unit 100 that is a ceiling concealed type has been described. However, the indoor unit 100 is not limited to a ceiling embedded type, and a wall hanging type may be used therefor. The case where the refrigerant leakage determination device 1 according to Embodiments 1 and 2 is used for the air-conditioning apparatus 200 has been described. However, the refrigerant leakage determination device 1 may be used not only for the air-conditioning apparatus 200, but also for other refrigeration apparatuses without limitation. Examples of the refrigeration apparatuses include any apparatus having a refrigeration cycle such as a refrigerator or a freezer. Also, the refrigerant leakage determination device 1 may be used not only for refrigeration apparatuses but also for other apparatuses that use refrigerant without limitation.

REFERENCE SIGNS LIST

1 refrigerant leakage determination device, 2 controller, 3 alarm device, 10 casing, 11 top plate, 12 side plate, 13 decorative panel, 13*a* opening port, 13*b* outer edge, 13*c* air outlet, 14 suction grille, 14*a* air inlet, 15 vane, 16 bell mouse, 20 air-sending device, 21 processing device, 22 storage device, 23 clocking device, 30 indoor heat exchanger, 31 compressor, 32 flow switching device, 33 outdoor heat exchanger, 34 expansion valve, 36 outdoor air-sending device, 40 electric component box, 50 refrigerant detection sensor, 51 sensor unit, 52 sensor control unit, 52*a* storage unit, 60 sensor holder, 100 indoor unit, 120 refrigerant pipe, 130 refrigerant pipe, 140 refrigerant circuit, 150 outdoor unit, 200 air-conditioning apparatus

The invention claimed is:

1. A refrigerant leakage determination device comprising:

a refrigerant detection sensor that detects presence of gas and transmits a concentration of the gas as a sensor output;

an alarm that issues an alarm about leakage of refrigerant; and a controller configured to control the alarm based on the sensor output from the refrigerant detection sensor, wherein the controller includes a storage that stores two thresholds for the sensor output associated with a refrigerant leakage state including a first set value and a second set value being predetermined and different from each other, and two set times each having a predetermined length different from each other including a first alarm postponement time associated with the first set value and a second alarm postponement time associated with the second set value, and a processor configured to determine that refrigerant leaks responsive to one or both of (i) a length of time period during which the sensor output exceeds the first set value being longer than the first alarm postponement time, and (ii) the length of time period during which the sensor output exceeds the second set value being longer than the second alarm postponement time; and actuate the alarm responsive to determining that the refrigerant leaks.

2. The refrigerant leakage determination device of claim 1, wherein the second set value is greater than the first set value, the second alarm postponement time is shorter than the first alarm postponement time.

3. The refrigerant leakage determination device of claim 2, wherein the refrigerant detection sensor includes a sensor unit that detects gas, and a sensor control unit having a sensor control processor and a memory, that converts a detection result by the sensor unit to the sensor output, and transmits the sensor output to the controller, responsive to the processing device determining leakage of refrigerant and determining that the sensor output exceeds the second set value, an abnormality record is stored in the memory, and after the abnormality record is stored in the memory, the sensor control unit constantly transmits the sensor output that exceeds the second set value to the controller.

4. An air-conditioning apparatus comprising:

a compressor that compresses refrigerant suctioned thereinto and discharges the refrigerant;

an outdoor heat exchanger that exchanges heat between refrigerant and outdoor air;

an indoor heat exchanger that exchanges heat between refrigerant and indoor air;

an expansion valve that regulates a pressure of refrigerant; and the refrigerant leakage determination device of claim 1.

5. A refrigerant leakage determination method comprising the steps of:

monitoring, by a controller, a sensor output from a refrigerant detection sensor;

determining, by the controller, whether or not the sensor output is greater than a predetermined first set value associated with a refrigerant leakage state stored in a storage by referring to data stored in the storage;

responsive to the controller determining that the sensor output is greater than the first set value, determining, by the controller, whether or not an elapsed time during which the sensor output exceeds the first set value is longer than a predetermined first alarm postponement time stored in the storage by referring to the stored data in the storage and a time obtained by a timer;

responsive to the controller determining that the sensor output is greater than the first set value, determining, by the controller, whether or not the sensor output is greater than a predetermined second set value that is stored in the storage, is greater than the first set value, and is associated with a refrigerant leakage state by referring to the data stored in the storage;

responsive to the controller determining that the sensor output is greater than the second set value, determining, by the controller, whether or not an elapsed time during which the sensor output exceeds the second set value is longer than a predetermined second alarm postponement time that is stored in the storage and is shorter than the first alarm postponement time by referring to the data stored in the storage and a time obtained by the timer;

responsive to the controller determining that the elapsed time during which the sensor output exceeds the first set value is longer than the first alarm postponement time, sending an alarm signal from the controller to an alarm to issue an alarm about leakage of refrigerant; and responsive to the controller determining that the elapsed time during which the sensor output exceeds the second set value is longer than the second alarm postponement time, sending an alarm signal from the controller to the alarm to issue the alarm about leakage of refrigerant.

6. The refrigerant leakage determination method of claim 5, further comprising the steps of:

responsive to the controller determining that the sensor output is greater than the second set value, storing an abnormality record in a memory of the refrigerant detection sensor; and after the abnormality record is stored in the memory, constantly transmitting, by a sensor control processor of the refrigerant detection sensor, the sensor output that is greater than the second set value to the controller.

* * * * *